US010961762B1

(12) United States Patent
Botu

(10) Patent No.: US 10,961,762 B1
(45) Date of Patent: Mar. 30, 2021

(54) DOOR CONTROL SYSTEM

(71) Applicant: Jack Botu, Capitola, CA (US)

(72) Inventor: Jack Botu, Capitola, CA (US)

( * ) Notice: Subject to any disclaimer, the term of this patent is extended or adjusted under 35 U.S.C. 154(b) by 53 days.

(21) Appl. No.: 16/876,836

(22) Filed: May 18, 2020

(51) Int. Cl.

| | |
|---|---|
| ***E05F 3/22*** | (2006.01) |
| ***E05F 15/53*** | (2015.01) |
| ***E05F 3/18*** | (2006.01) |
| ***E05F 1/14*** | (2006.01) |
| ***F25D 23/02*** | (2006.01) |

(52) U.S. Cl.
CPC ..... *E05F 3/224* (2013.01); *E05F 1/14* (2013.01); *E05F 3/18* (2013.01); *E05F 15/53* (2015.01); *F25D 23/02* (2013.01); *F25D 23/028* (2013.01); *E05Y 2900/31* (2013.01)

(58) Field of Classification Search
CPC ..... E05F 3/224; E05F 3/227; E05F 15/53; E05Y 2900/31; F25D 23/02; F25D 23/028
USPC ..... 312/326, 324, 405
See application file for complete search history.

(56) References Cited

U.S. PATENT DOCUMENTS

| | | | | |
|---|---|---|---|---|
| 3,297,293 | A * | 1/1967 | Andrews | E04G 21/142 248/499 |
| 3,895,849 | A * | 7/1975 | Zehr | E05F 5/12 312/324 |
| 4,146,994 | A * | 4/1979 | Williams | E05B 63/20 49/367 |
| 4,688,352 | A | 8/1987 | Kinoshita | |
| 6,338,536 | B1 * | 1/2002 | Ueno | E05B 17/0033 312/405 |
| 6,407,912 | B1 * | 6/2002 | Chen | G06F 1/181 312/223.1 |
| 7,146,766 | B2 | 12/2006 | Finkelstein | |
| 7,819,488 | B2 * | 10/2010 | Lee | F25D 23/028 312/405 |
| 8,217,611 | B2 * | 7/2012 | Ennis | F25D 23/028 318/445 |
| 8,444,237 | B2 * | 5/2013 | Kang | F25D 23/028 312/405 |
| 8,653,767 | B2 | 2/2014 | Kim | |
| 8,981,698 | B2 | 3/2015 | Fuhge | |
| 9,814,311 | B2 * | 11/2017 | Mueller | A47B 96/00 |
| 10,301,865 | B2 | 5/2019 | Son et al. | |
| 2007/0186480 | A1 | 8/2007 | Freeman | |

(Continued)

*Primary Examiner* — Marcus Menezes
(74) *Attorney, Agent, or Firm* — The Law Firm of Andrea Hence Evans, LLC

(57) ABSTRACT

The door control system includes a baseplate configured to interface with a surface adjacent to a door. The baseplate is removeably fastened to the surface oriented above to the door. The system includes at least one door ram coupled to the baseplate. The door ram includes a ram arm. The ram arm is configured to extend or retract from the door ram. The system includes at least one door actuator coupled to the baseplate. The at least one door actuator comprises an actuator arm. The actuator arm is configured to extend or retract from the door actuator. The door control system comprises at least one biasing device coupled to the baseplate and the at least one door actuator. The door control system also includes a controller in communication with the at least one door ram and the at least one door actuator configured to actuate an opening motion or a closing motion by the at least one door ram and the at least one door actuator.

15 Claims, 7 Drawing Sheets

(56) References Cited

U.S. PATENT DOCUMENTS

| | | | | |
|---|---|---|---|---|
| 2009/0033189 | A1* | 2/2009 | Glanz | E05F 15/63 312/405 |
| 2009/0091220 | A1* | 4/2009 | Eyer | A47B 96/00 312/215 |
| 2009/0139141 | A1* | 6/2009 | MacLeod | E05F 15/53 49/21 |
| 2016/0116206 | A1* | 4/2016 | Kempfle | F25D 23/028 312/405 |

* cited by examiner

DOOR CONTROL SYSTEM

FIELD OF DISCLOSURE

The present disclosure relates to a door control system and more particularly a system automated to open and close an appliance door.

BACKGROUND

Opening or closing a door typically requires the application of a force to overcome a locking mechanism or negative pressure keeping the door shut. In some situations, opening and closing doors to an entry way or appliance is inconvenient due to temporary or permanent physical disabilities. The physical disability can prevent the user from providing the required force necessary to open or close the door. Accordingly, there remains a need for an improved comprehensive and efficient way to address the problem of opening and closing doors. This need and other needs are satisfied by the various aspects of the present disclosure.

SUMMARY

Some or all of the above needs and/or problems may be addressed by certain embodiments of the disclosure. In accordance with the purposes of the disclosure, as embodied and broadly described herein, the disclosure, in one aspect, relates to a door control system. An embodiment of the door control system can include a baseplate configured to interface with a surface adjacent to a door. The baseplate can be removably fastened to the surface adjacent to the door. The system can include at least one door ram coupled to the baseplate. The door ram can include a ram arm. The ram arm is configured to extend or retract from the door ram. The system can include at least one door actuator coupled to the baseplate. The door actuator can comprise an actuator arm. The actuator arm is configured to extend or retract. The door control system can comprise a biasing device coupled to the baseplate and the door actuator. The door control system can also include a controller in communication with the door ram and the door actuator. The controller is configured to actuate an opening motion or a closing motion by the door ram and the door actuator.

Another embodiment of the door control system can include a baseplate configured to interface with a surface adjacent to a door. The baseplate can be removably fastened to the surface adjacent to the door. The system can include at least one door ram coupled to the baseplate. The door ram can include a ram arm. The ram arm is configured to extend or retract from the door ram. The system can include at least one door actuator coupled to the baseplate. The at least one door actuator can comprise an actuator arm. The actuator arm is configured to extend or retract. The door control system can comprise at least one biasing device coupled to the baseplate and the at least one door actuator. The door control system can also include a controller in communication with the at least one door ram and the at least one door actuator configured to actuate an opening motion or a closing motion by the at least one door ram and the at least one door actuator. The door control system can further comprise smart device in communication with the controller. The controller can transmit signals from the smart device to the at least one door ram and the at least one door actuator.

Another embodiment of the disclosure comprises a method for controlling a refrigerator door. The method can comprise coupling with removable fasteners a door control system to a surface of a refrigerator adjacent to a refrigerator door. The door control system can include a controller, a door ram, and a door actuator. The controller is in communication with the door ram and the door actuator. The method can comprise actuating the refrigerator door by the controller. Actuating the refrigerator door can comprise receiving a command signal from a remote control, or receiving a voice command from a smart device. The method can also include transmitting by the controller an actuating signal to at least one of: the door ram coupled to the refrigerator door or the door actuator coupled to the refrigerator door.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate several aspects of the disclosure and together with the description, serve to explain the principles of the disclosure.

DETAILED DESCRIPTION

Figure 1:
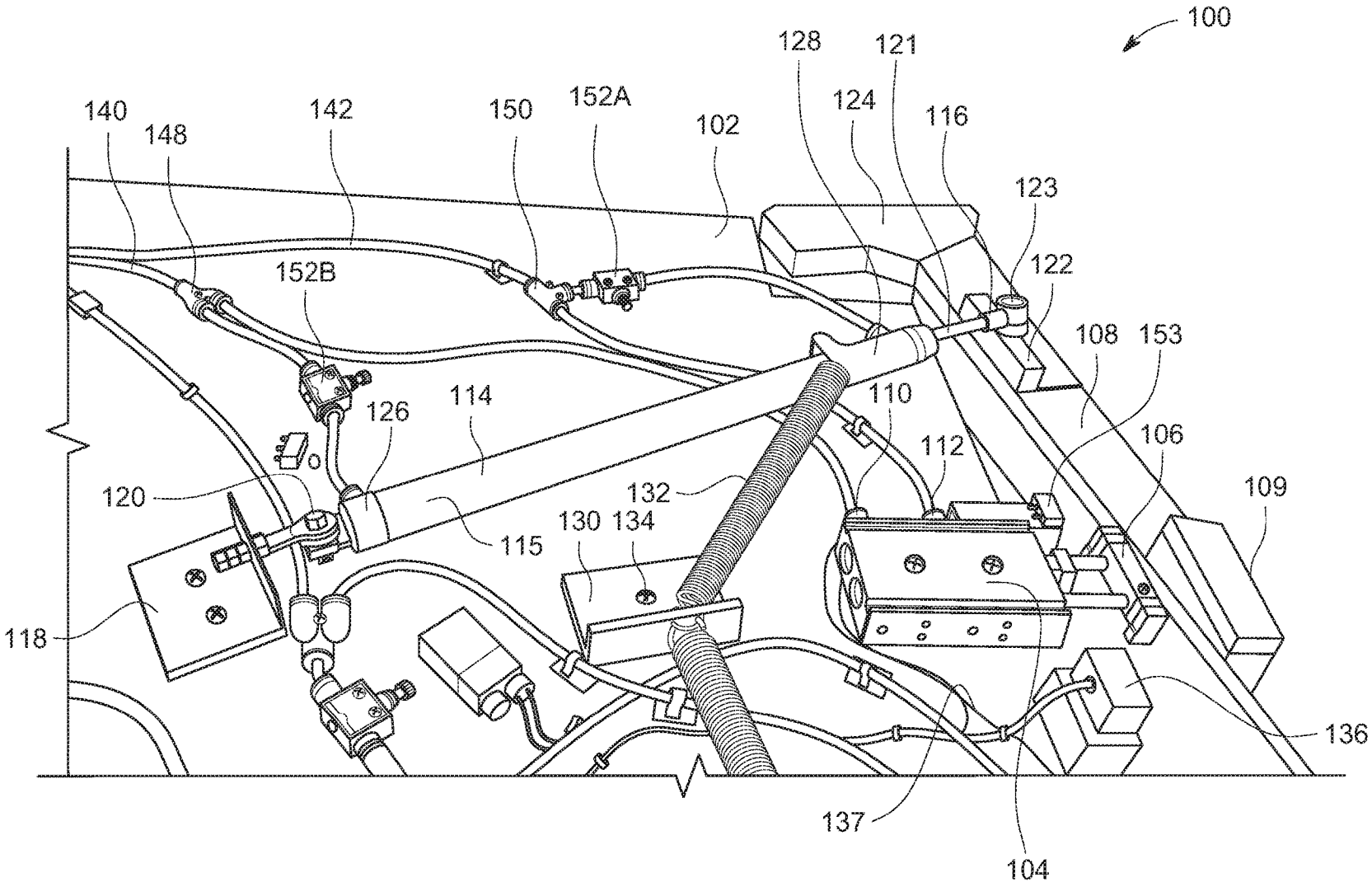
FIG. 1 depicts an isometric view of an exemplary embodiment of the present disclosure.

The present disclosure can be understood more readily by reference to the following detailed description of the disclosure and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described. All publications mentioned herein are incorporated herein by reference to disclose and describe the methods and/or materials in connection with which the publications are cited.

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated by some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another unless specifically stated otherwise.

As used herein, the terms "optional" or "optionally" mean that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited, each is individually and collectively contemplated, meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the disclosure. Thus, if there are a variety of additional steps that can be performed it is understood that each of these additional steps can be performed with any specific aspect or combination of aspects of the methods of the disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

DETAILED DESCRIPTION

As briefly described above, the present disclosure relates, in various aspects, to a door control assembly. As shown in FIG. 1, the door control system 100 can comprise a baseplate 102. The baseplate 102 can be a board that is configured to interface with a surface of an appliance or a door. In one aspect, the baseplate 102 can comprise a rigid material such as a rigid plastic or polymer, fiberglass composite, metal or wood-based product. The door control system 100 can further comprise a door ram 104. The door ram 104 can comprise a platform or housing coupled to the baseplate 102. The door ram 104 can be coupled to the baseplate 102 adjacent to the door 108 of the refrigerator. The door ram 104 can operate to initiate opening the door 108 of the refrigerator. The door ram 104 can provide an opening force to the door by relieving the negative pressure holding the refrigerator door 108 shut. The door ram 104 can comprise a ram arm 106. The ram arm 106 can be a member that extends from the door ram 104. When the door ram 104 initiates opening the door 108, the ram arm 106 can extend from the door ram 104 to engage a portion of the door 108. The force provided by the ram arm 106 can exceed the force holding the refrigerator door 108 shut. In one aspect, the ram arm 106 can engage the door 108 at a door bracket 109. The door bracket 109 can be a rigid fixture coupled to a top portion of the door.

The door ram 104 can be pneumatically powered with pressurized air supplied by air tubes 110 and 112. Generally, the air tubes of the door control system 100 are structured to support the pressurized air generated by an air compressor (not shown). As shown in FIG. 1, the air tube 110 can be connected to a proximal (rear) portion of the door ram 104; the second air tube 112 can be connected to the distal (front) portion of the door ram 104. When air is supplied to the proximal tube 110, the pressurized air can cause ram arm 106 to extend linearly from the door ram 104, engaging the door 108 at the door bracket 109. Conversely, when compressed air is supplied to the distal tube 112, the pressurized air can cause the ram arm 106 to retract into the door ram 104. The ram arm 106 can be actuated to extend based on an actuating signal sent from a controller 154 (not shown). In another embodiment, the ram 104 can comprise a solenoid comprising an electromagnet, similarly receiving an actuating signal from the controller 154.

The door control system 100 can also comprise a door actuator 114. After the door 108 has been opened by the ram arm 106, the door actuator 114 can increase the angle of the door 108 by apply an additional force to the door 108. In another aspect, the actuation by the door ram 104 and door actuator 114 can occur simultaneously. The door actuator 114 can comprise an actuator arm 116. The door actuator 114 and the actuator arm 116 can resemble and function like a pneumatic piston. The door actuator can be a pressurized tube; and the actuator arm 116 can be beam or rod that is configured to linearly extend or retract from the door actuator 114. The door actuator 114 can be coupled to the refrigerator door 108 on at least two engagement points: a proximal end 115 and distal end 121 of the door actuator. The proximal end 115 of the door actuator 114 can be coupled to the refrigerator door at a spring bracket 130.

In a further aspect, the proximal end 115 of the door actuator 114 can be coupled to the spring bracket 130 by a rotational coupling 120. The rotational coupling 120 can provide the door actuator 114 proximal end 115 with a three-dimensional degree of freedom. The three dimensional range of motion for the proximal end 115 can mitigate the actuator arm 116 from jamming due to counter-active forces, while still allowing the actuator arm to provide a constant force on the door 108. For example, the rotational coupling 120 can allow the proximal end 115 to rotate, translate laterally, and translate vertically. The rotational coupling 120 can comprise, but not limited to: an eye bolt; a swivel hoist ring, a swivel bolt, or a universal joint, or the like.

The distal end 121 of the door actuator 114 can be coupled to the refrigerator door 108 with a door brace 122. Similar to the proximal end 115, actuator arm 116 can be coupled to the door brace 122 by a second rotational coupling 123. The second rotational coupling 123 can be an eye bolt; a swivel hoist ring, a swivel bolt, or a universal joint, or the like. Similar to the first rotational coupling 120, the second rotational coupling 123 can allow the distal end 121 of the actuator arm to rotate as the refrigerator door 108 rotates around the door hinge 124.

Similar to the door ram, the door actuator 114 can be pneumatically powered to facilitate opening the door 108. Compressed air can be supplied by an air tube 126 at the proximal end 115 of the actuator 114 and the air tube 128 at the distal end 121 of the door actuator. Similar to the door ram 104, the compressed air supplied by the tubes 126 and 128 can be provided by an air compressor (not shown). Air supplied to the proximal end 115 through the air tube 126 can cause the actuator arm 116 to extend from the door actuator 114. Air supplied to the distal end 121 or the actuator 114 can cause the actuator arm 116 to retract.

As mentioned earlier, pneumatic powering of the door control system 100 can include compressed air supplied by an air compressor. In one aspect, the air supplied by the compressor is connected to air tubes 140 and 142. The air tube 140 can be the primary air supply for the extension motion of the door ram 104 and the door actuator 114. In particular, the extension air tube 140 can supply air to both air tubes 126 located at the proximal (rear) end of the door actuator 114 and air tube 110 located at the proximal (rear) end of the door ram 104. The air tube 140 can supply air to both locations by the use of a flow splitter 148. Similarly, a retraction air tube 142 can supply air to both air tubes 128 located at the distal (front) end of the door actuator 114 and air tube 112 located at the distal (front) end of the door ram 104. The air tube 140 can supply air to both locations by the use of a second flow splitter 150. In yet a further aspect, the air tube arrangement between the retraction air tube 142 and the extension air tube 140 can further comprise air regulators 152A-B. The air regulators 152A-B can comprise an adjustable valve. The adjustable valve of the air regulators 152A-B can reduce or increase the amount of air passing through the respective air tubes. The change in airflow can subsequently adjust the pressure exerted on the actuator arm 116 or ram arm 106.

The door control system 100 can also comprise a biasing device 132 to facilitate a smooth transition between extension and retraction of the door actuator 114. The biasing device 132 can be coupled to a portion of the door actuator 114 to control the speed of the extension or retraction of the actuator arm 116. The biasing device 132 can comprise a spring wherein one portion of the spring is coupled to a portion of the door actuator 114 and a second end of the spring is coupled to a spring bracket 130. The spring bracket 130 to the baseplate 102 can also be fastened with a single engagement point 134. The single engagement point 134 provides a degree of freedom to rotate around a fastener that couples the baseplate 102 to the spring bracket 130. The degree of freedom permits additional adjustment or customization during repairs or installation. The spring bracket 130 can be a rigid material comprising metal, plastic, fiberglass, or a combination of materials.

When the actuator arm 116 extends, the spring 132 can increase potential energy. The extending spring generates potential energy and generates a counteractive force on the extension of the actuator arm 116 as it extends. The counteractive force generated by the spring can mitigate the speed and force at which the door 108 opens or closes. When the door closes, the actuator arm 116 will retract into the door actuator 114; the potential energy built up in the spring 132 can dissipate and aid in pulling the door 108 shut. In a further aspect, the biasing device 132 can also include a damper which can also produce the same and additional counteractive forces exhibited by a spring.

The door control system 100 can also comprise an indictor device 136. The indicator device 136 can be used to identify the operational status of the door control system. For example, the operational status can describe whether the refrigerator is open, closed, or potentially malfunctioning. The indicator device 136 can include a visual indicator or an audible indicator. The visual indicator can be a light, such as an incandescent bulb or light emitting diode (LED) that emits a lighting sequence when the door is opening, closing, or exhibiting a malfunction. The audible indicator can comprise a device such as a speaker for example, that produces an audible tone or series of tones when the door is opening, closing, or exhibiting a malfunction. In a further aspect, the indicator device 136 can receive a signal from one of the other components of the door control system, such as the processor (not shown) or sensor 153, via a signal wire 137. The indicator device 136 can also be powered by an auxiliary power source such as a battery.

The door control assembly can also include a sensor 153. The sensor 153 can be any device configured to measure data associated with the components of the door control system 100. For example, the sensor 153 can be a voltmeter, linear displacement sensor, or pressure transducer. As a pressure transducer 153, the sensor can determine whether the door 108 is open or closed. In another aspect, the sensors 153 can be linear displacement sensors. For example, the linear displacement sensors can indicate the linear extension or retraction of the actuator arm 116 and ram arm 106.

Figure 2:
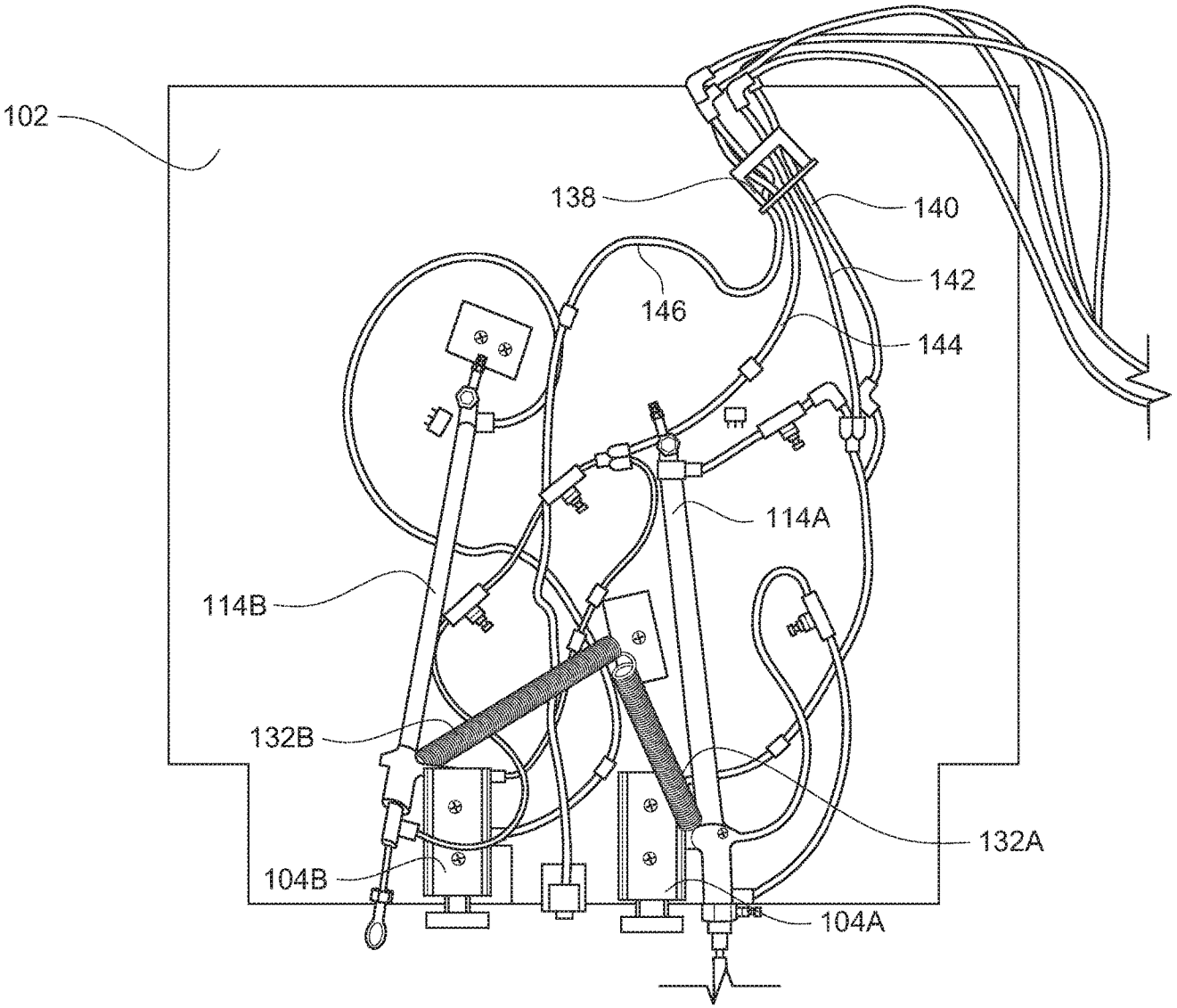
FIG. 2 depicts a top view of an exemplary embodiment of the present disclosure.

As shown in FIG. 2, the door control system 100 can be configured to have multiple door actuators 114A-B, door rams 104A-B, and biasing devices 132 A-B to open and close a refrigerator with multiple doors. In one aspect, a rear portion of the refrigerator can comprise a hose bracket 138. The hose bracket 138 can be a bracket that is coupled to the baseplate 102. The hose bracket 138 can hold and secure the tubes supplying compressed air from the compressor (not shown). As shown in FIG. 2, the hose bracket 138 can hold four air tubes coming from a compressor. Air tubes 140, 142 can supply the pressurized air to the door ram 104A and the door actuator 114A. Similarly, air tubes 144, 146 can supply the pressurized air to the door ram 104B and the door actuator 114B.

Figure 3:
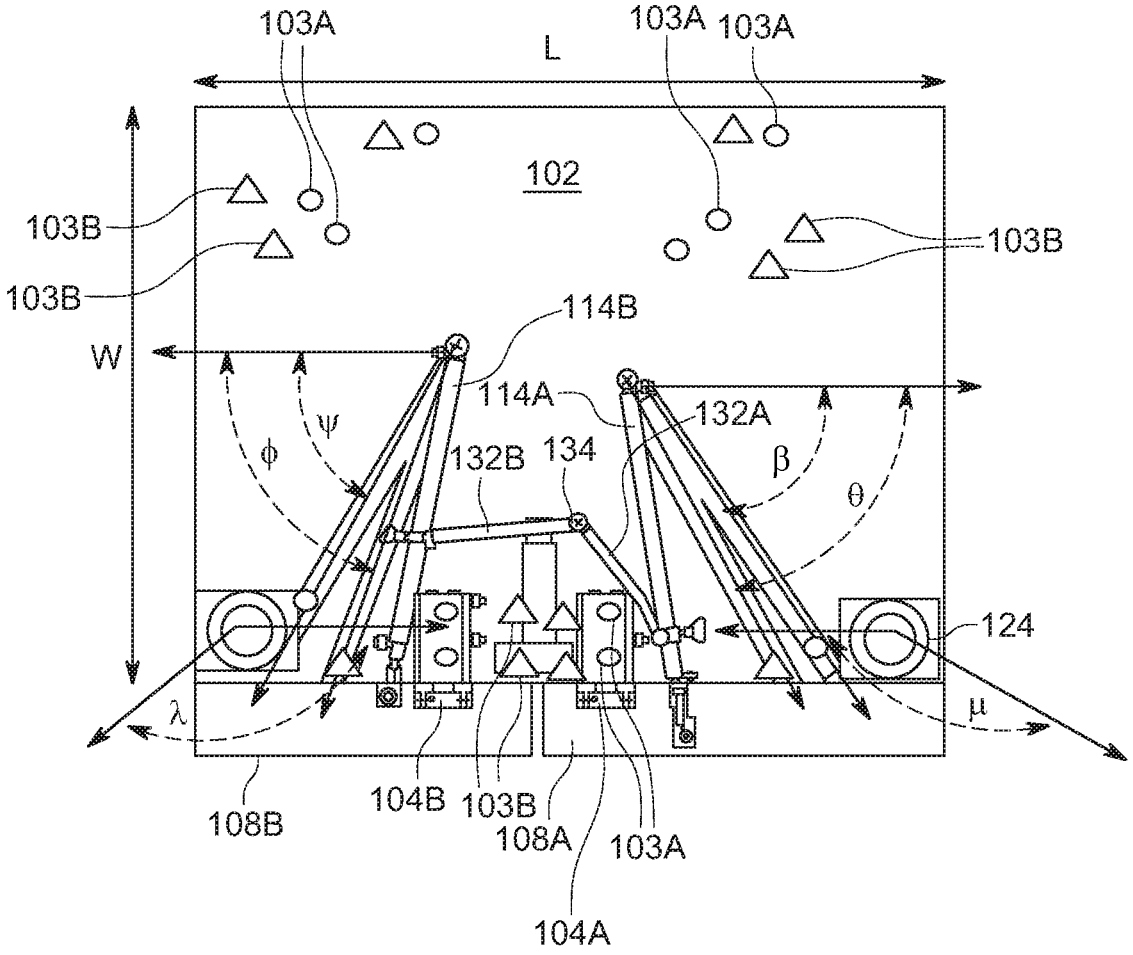
FIG. 3 depicts a top view of a baseplate of the present disclosure.

In yet a further aspect as shown in FIG. 3, the baseplate 102 can comprise a plurality of apertures 103. The apertures 103 can be oriented to permeate through baseplate 102. The apertures 103 can be of sufficient size to allow fasteners such as screws, bolts, or the like, to allow the various components of the door control system 100 to be coupled to the baseplate 102. The apertures 103A-B can be pre-drilled in defined configurations to allow for easier installation of the door control system components to the baseplate 102. For example, the apertures 103 can be arranged with the pattern 103A consistent with circular aperture markers or pattern 103B consistent with triangular aperture markers. These two distinct patterns facilitate customization of the door control system components during installation. The distinct patterns also allow the door control system to be used for different models of refrigerators.

During installation of the door control system 100, the interface between a bottom surface of the baseplate 102 and the top surface of the refrigerator can be removably fastened. Removable fasteners can comprise a class of fasteners that do not require a tool such as pliers, screwdrivers or the like, to engage the fastener in coupling the baseplate 102 to a surface. For example, hook and loop fasteners, double-sided tape, magnets, pins, latches, or the like can be used to engage the bottom surface of the baseplate 102 and the top surface of the refrigerator. The removable fasteners can be used to facilitate easier and faster installation or removal of the baseplate 102 from the refrigerator surface when additional customization or repairs to the door control system 100 need to be made.

In another embodiment, the baseplate 102 can comprise a foldable configuration. In the foldable configuration, the rigid components of baseplate 102 can be configured to fold along a length (L) dimension or a width (W) dimension of the baseplate 102. To maintain the overall rigidity and ability to fold, portions of the baseplate 102 can be coupled with hinges along the length dimension or the width dimension of the baseplate. In yet another embodiment, the baseplate 102 can be separated into distinct pieces that can be coupled together. Those pieces can be coupled together by a snap-fit or tongue-and-grove engagement or the like to complete a full baseplate 102. In both cases, the folded configuration and the separated configuration of the baseplate 102 can provide ease of transport for the baseplate prior to installation.

As shown in FIG. 3, the arrangement of the circular and triangular aperture markers 103A-B facilitate the door actuators 114A-B being oriented at various angles on the baseplate 102. Door actuator 114A can be oriented to extend along angles ($\theta$ and $\beta$). In one aspect, the baseplate angles $\theta$, $\beta$ can open and close ranging from between 0 and about 90 degrees. In exemplary aspects, baseplate angles $\theta$, $\beta$ can range from about 40 degrees to about 80 degrees or optionally, from about 50 degrees to about 70 degrees. Similarly, door actuator 114B can be oriented to extend and retract along a second set of baseplate angles ($\psi$ and $\varphi$). In one aspect, the baseplate angles $\psi$ and $\varphi$ can open and close to a range between 0 and about 90 degrees. In exemplary aspects, baseplate angles $\psi$, $\varphi$ can range from about 40 degrees to about 80 degrees or optionally, from about 50 degrees to about 70 degrees. The baseplate angles $\theta$, $\beta$ $\psi$, and $\varphi$ can be set to define the opening angles ($\mu$, $\lambda$) for doors 108A-108B, as the doors 108A-B rotate around the door hinge 124. In one aspect, the opening angles $\mu$, $\lambda$, can open and close to a range between 0 and about 120 degrees.

In a further aspect, the door control system 100 can further comprise a controller 154. In FIG. 4-7, the controller 154 can be used to control the operation of the components of the door control system 100. In one aspect, the controller 154 can be housed in a self-contained unit. The self-contained unit can be in a case or housing that is protectable from environmental elements, such as temperature and moisture, while still allowing the controller to communicate wirelessly to other components of the door control system 100. In a further aspect, the controller 154 can comprise a processor 156.

The processor 156 can include but is not limited to personal computers, server computers, laptop devices, and multiprocessor systems. Additional examples comprise set-top boxes, programmable consumer electronics, network PCs, minicomputers, and mainframe computers, distributed computing environments that comprise any of the above systems or devices, and the like. The processing of the disclosed methods and systems can be performed by software components. The disclosed systems and methods can be described in the general context of computer-executable instructions, such as program modules, being executed by one or more of the processors 156.

The processor 156 can also be configured to send actuating signals as electrical pulses to other components of the door control system. In yet a further aspect, the door control system 100 can comprise multiple processors 156. The embodiment with multiple processors 156 can be configured to have the processors in communication with each other. In a further aspect, one processor can be configured to control the compressor 164 and a second processor can be used to control valves 166 in the door control system 100. The processor 156 can further comprise an antenna 158. The antenna 158 can send or receive signals wirelessly through various communication networks 159 including: cloud computing networks, local area networks (LAN) wireless networks, mesh network, Bluetooth®, ZigBee®, Z-wave, or the like. In a further aspect, the communication network can also facilitate radio frequency (RF) communication. The processor 156 can be configured to send and receive electrical signals from sensors 153A-C attached to the other components of the door control system.

The controller can further comprise a directional valve 166. The directional valve can be in communication with the processor 156. The processor 156 can provide a command signal to direct the directional valve 166 to adjust its flowrate or change the direction of the air flow passing through the valve 166. The direction of the air flow through the valve can determine if the door actuator 114 (door ram 104) is in an extension motion or retraction motion. The directional valve 166 can also provide data to the processor via sensor 153A. The directional valve 166 can comprise 2-way, 3-way, 4-way, or 5-way valve. In another aspect, the directional valve can be electrically controlled, such as a solenoid valve. In another embodiment, the directional valve 166*be* a manual valve such as a globe valve or rotary type valve. Other types of valves are also considered.

Figure 4:
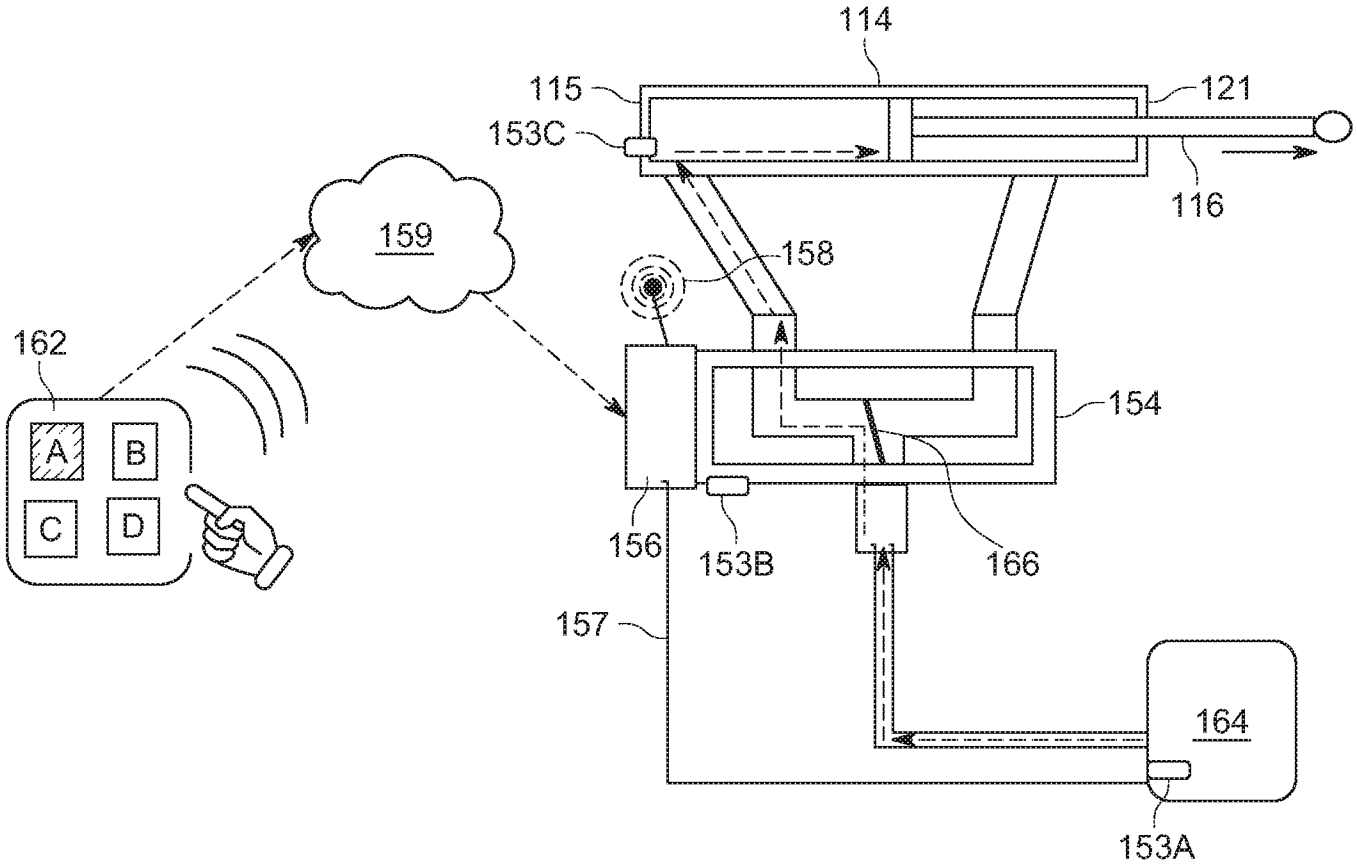
FIG. 4 depicts a schematic diagram of an alternative embodiment in a door extension phase.

The controller 154 further comprises a remote control or transmitter 162. The transmitter can be a hand-held fob. The fob 162 can have a plurality of buttons, where each button can send a different command signal. For example, as shown in FIG. 4, the user can initiate an extension of the door actuator 114 (and door ram 104) by pressing the A button. The fob 162 can produce a unique signal sent through the communication network 159. The signal can be received by the antenna 158 of the processor 156. The signal produced by the A button can tell the processor 156 to command the valve 166 to direct the compressed air from the air compressor 164 to the proximal (rear) end 115 of the door actuator 114. The processor 156 can communicate electronically with the compressor 164 via the wire 157. The compressor can also provide data to the processor via sensor 153B. The compressed air entering into the proximal (rear) end 115 can cause the door actuator 114 (door ram 104) to extend the actuator arm 116 (ram arm 106). The actuator arm 116 (ram arm 106) can also provide data to the processor 156 via sensor 153C.

Figure 5:
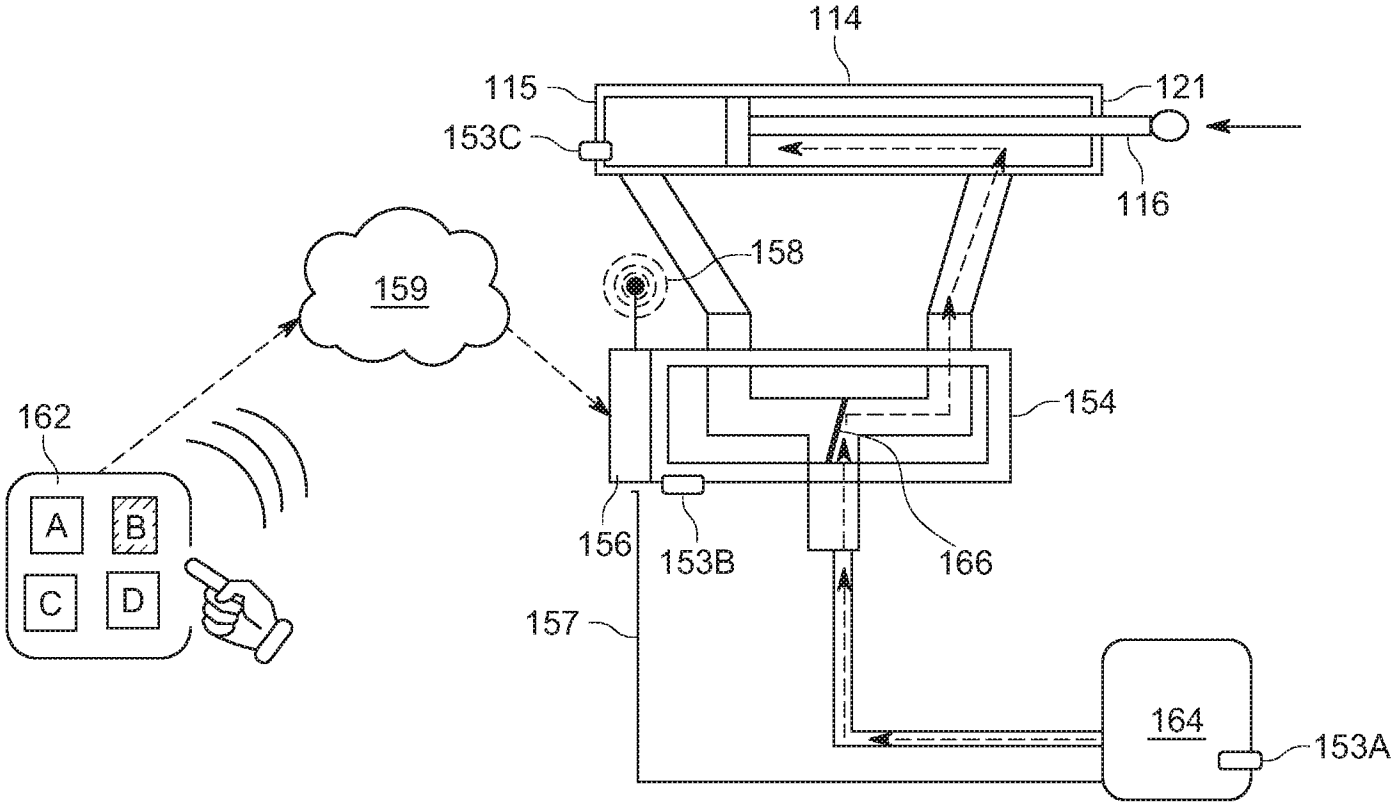
FIG. 5 depicts a schematic diagram of an alternative embodiment in a door retraction phase.

As shown in FIG. 5, during a retraction cycle, a user can press the B button. A second unique signal emitted from the fob 152 for the B button can prompt the processor 156 to cause the valves 166 to direct the compressed air from the compressor 164 to distal (front) 121 ends of the door actuator 114. The compressed air entering into the distal (front) end 121 can cause the door actuator 114 (door ram 104) to retract the actuator arm 116 (ram arm 106).

Figure 6:
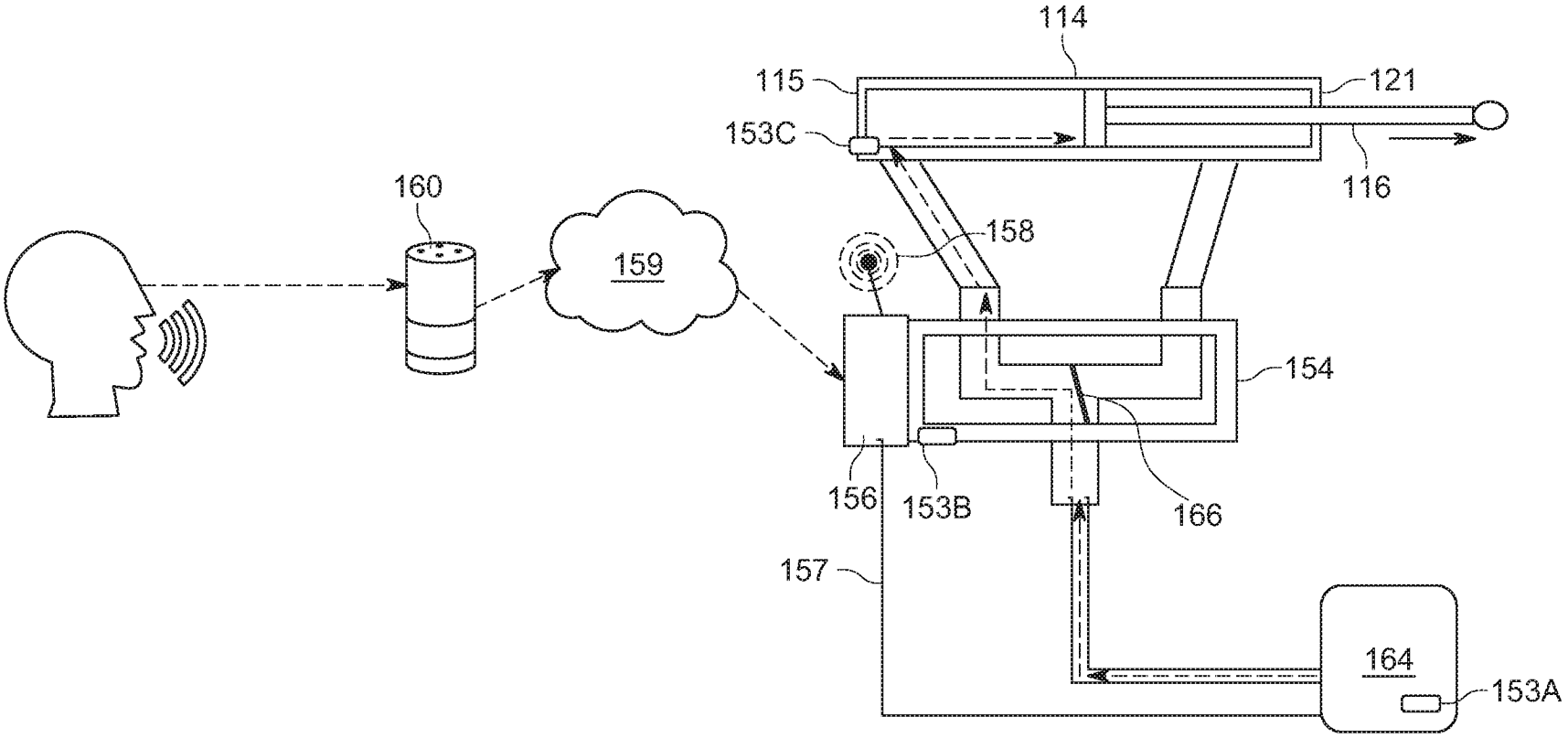
FIG. 6 depicts a schematic diagram of a second alternative embodiment in a door extension phase.
Figure 7:
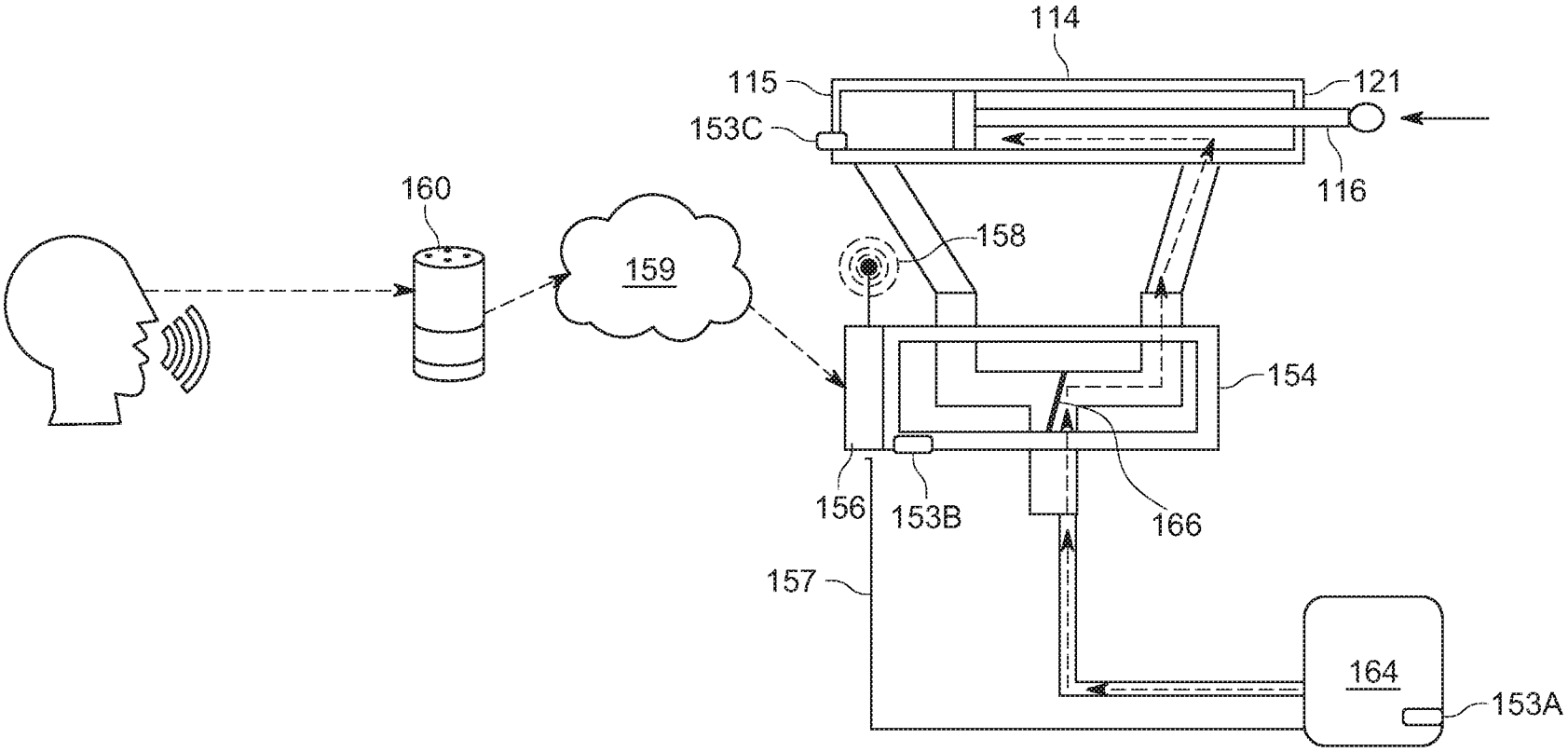
FIG. 7 depicts a schematic diagram of a second alternative embodiment in a door retraction phase.

In another embodiment as shown in FIG. 6-7, the controller 154 can also comprise components to enable voice-activation of the door control system 100. The controller 154 can comprise a smart device 160. The smart device 160 can be configured to include a microphone and internal processor to convert audible voice commands provided by a user into a signal. The smart device can function similar to the Amazon Alexa®, Microsoft Cortana®, or Google Assistant®. The command signal can be transmitted by the smart device 160 to the antennae 158 of processor 156 via the various communication networks 159. Once the command signal is received, the processor 156 can initiate an action by the door control system 100 to open a door 108 or close the door. The smart device 160 can be integrated with virtual assistant software to initiate an action after receiving a hot (activation) word or series of hot words. For example, the user can speak the phrase "Smart device, open refrigerator door." The smart device 160 can convert the spoken language into a signal for the processor 156. The smart device device 160 can transmit the converted voice signal via the communication networks 159 to the processor 156. As shown in FIG. 6, the processor 156 can send a signal to the valve 166. During a door-opening command, the compressed air can be directed through the valve 166 to the proximal (rear) end 115 of the door actuator 114 (door ram 104). The compressed air entering into the proximal (rear) end 115 of the door actuator 114 (door ram 104) can cause the actuator arm 116 (ram arm 106) to extend. Similarly, as shown in FIG. 7, the processor 156 can send a signal to the valve 166, in response to a door-closing command. The compressed air from the compressor 164 can be directed through the valve 166 to the distal (front) ends 121 of the door actuator 114 (door ram 104). The compressed air entering into the distal (front) ends 121 of the door actuator 114 can cause the actuator arm 116 (ram arm 106) to retract. Overall, it is understood that the controller 154 can comprise additional valves 166, processors, 156, and sensors.

In a further aspect, the performance of the controller 154 can be customized to define: 1) a maximum angle that the doors open; 2) speed at which the doors open; and 3) the maximum force with which a door opens or closes. In a further aspect, the controller 154 can be configured with additional safety protocols. After the controller 154 has transmitted an actuating signal to initiate motion by the door ram 104 or door actuator 114, the controller 154 can receive response signals from the sensors 153. For example, the controller 154 can receive signals from the sensors 153 indicating excess pressure in the pneumatic tubes. For example, the control system 100 can operate at 5 psi above ambient pressure. In one aspect, resistive pressure placed on an opening door can stop the motion of the door. A sensor 153 can identify an increase or decrease of pressure and send the sensor data to the controller 154. In response, the controller 154 can send a response signal to the valve(s) 166 and compressor(s) 164 to direct the air flow to the air tubes that will cause a reverse or stoppage in the motion of the door.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior disclosure. Further, the dates of publication provided herein can be different from the actual publication dates, which can require independent confirmation.

The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

What is claimed:

1. A door control system comprising:

a baseplate configured to interface with a surface oriented above a door, wherein the baseplate is removeably fastened to the surface oriented above the door, wherein the baseplate comprises a foldable configuration, such that a portion of the baseplate folds along at least one dimension of the baseplate;

at least one door ram coupled to the baseplate comprising a ram arm, wherein the ram arm is configured to extend or retract from the at least one door ram;

at least one door actuator coupled to the baseplate comprising an actuator arm, wherein the actuator arm is configured to extend or retract, wherein the baseplate further comprises a plurality of apertures, wherein the plurality of apertures are subdivided into a first group of apertures and a second group of apertures, wherein the first group and second group of apertures define a first and a second pattern, respectively, in the baseplate consistent with a first placement and a second placement of the at least one door ram and the at least one door actuator when coupled to the baseplate;

at least one biasing device coupled to the baseplate and the at least one door actuator; and a controller in communication with the at least one door ram and the at least one door actuator configured to actuate an opening motion or a closing motion by the at least one door ram and the at least one door actuator.

2. The door control system of claim 1, further comprising an air compressor in fluid communication with the at least one door ram and the at least one door actuator.

3. The door control system of claim 2, further comprising at least one directional valve configured to direct compressed air from the air compressor to the at least one door ram and the at least one door actuator.

4. The door control system of claim 1, wherein the controller further comprises a remote control device in wireless communication with the controller.

5. The door control system of claim 1, wherein the door control system further comprises an indicator device, wherein the indicator device is configured to provide an operational status of the door control system.

6. The door control system of claim 5, wherein the indicator device comprises at least one of a visual indicator or an audible indicator.

7. The door control system of claim 5, wherein the indicator device comprises an auxiliary power source.

8. The door control system of claim 1, wherein the at least one door actuator further comprises a coupling configured to facilitate three dimensional motion of the at least one door actuator during the opening motion or the closing motion of the door.

9. The door control system of claim 1 further comprising at least one sensor in communication with the controller and configured to provide operational data on the door control system.

10. A door control system comprising:

a baseplate configured to interface with a surface oriented above a door, wherein the baseplate is removeably fastened to the surface oriented above the door wherein the baseplate comprises a foldable configuration, such that a portion of the baseplate folds along at least one dimension of the baseplate;

at least one door ram coupled to the baseplate comprising a ram arm, wherein the ram arm is configured to extend or retract from the door ram;

at least one door actuator coupled to the baseplate comprising an actuator arm, wherein the actuator arm is configured to extend or retract, wherein the baseplate further comprises a plurality of apertures, wherein the plurality of apertures are subdivided into a first group of apertures and a second group of apertures, wherein the first group and second group of apertures define a first and a second pattern, respectively, in the baseplate consistent with a first placement or a second placement of the at least one door ram and the at least one door actuator when coupled to the baseplate;

at least one biasing device coupled to the baseplate and the at least one door actuator;

a controller in communication with the at least one door ram and the at least one door actuator configured to actuate an opening motion or a closing motion by the at least one door ram and the at least one door actuator; and a remote control device in communication with the controller, wherein the controller can transmit signals to the at least one door ram and the at least one door actuator.

11. The door control system of claim 10 further comprising an air compressor in fluid communication with the at least one door ram and the at least one door ram and the at least one door actuator.

12. The door control system of claim 11, further comprising at least one directional valve configured to direct compressed air from the air compressor to the at least one door ram and the at least one door actuator.

13. The door control system of claim 10, wherein the door control system further comprises an indicator device, wherein the indicator device is configured to provide an operation status of the door control system.

14. The door control system of claim 13, wherein the indicator device comprises at least one of a visual indicator or an audible indicator.

15. The door control system of claim 13, wherein the indicator device comprises an auxiliary power source.

* * * * *